United States Patent [19]

Ito et al.

[11] 4,392,740

[45] Jul. 12, 1983

[54] PAPER TRANSPORT CONTROL DEVICE FOR USE IN MECHANICAL ARRANGEMENT INCLUDING MANUAL PAPER FEEDING MECHANISM

[75] Inventors: Masazumi Ito, Toyokawa; Kenji Shibazaki, Aichi, both of Japan

[73] Assignee: Minolta Camera Kabushiki Kaisha, Osaka, Japan

[21] Appl. No.: 254,275

[22] Filed: Apr. 15, 1981

[30] Foreign Application Priority Data

Apr. 15, 1980 [JP] Japan ..... 55/49829
Feb. 27, 1981 [JP] Japan ..... 56/29109

[51] Int. Cl.[3] ..... G03G 15/00
[52] U.S. Cl. ..... 355/14 SH; 355/3 SH
[58] Field of Search ..... 355/14 SH, 14 R, 3 SH; 271/227, 228, 258, 259, 260

[56] References Cited

U.S. PATENT DOCUMENTS 3,865,482 2/1975 Bendall et al. ..... 355/14 SH
3,950,090 4/1976 Washio et al. ..... 355/8
3,960,446 6/1976 Ogawa et al. ..... 355/14 SH

*Primary Examiner*—R. L. Moses
*Attorney, Agent, or Firm*—Wenderoth, Lind & Ponack

[57] ABSTRACT

An improved paper transport control device for use in a mechanical arrangement including a manual paper feeding mechanism, in which at least one of the mechanical operations, such as jam detection, is caused to be inoperative when the paper is drawn out within a predetermined period of time after the paper has been fed manually, so as to enable the immediate resumption of the next mechanical operation even if the paper is drawn out after the manual paper feeding has been started, thus significantly improving the working efficiency of the device.

8 Claims, 12 Drawing Figures

(Manual paper feeding)

PAPER TRANSPORT CONTROL DEVICE FOR USE IN MECHANICAL ARRANGEMENT INCLUDING MANUAL PAPER FEEDING MECHANISM

BACKGROUND OF THE INVENTION

The present invention generally relates to a mechanical arrangement including a manual paper feeding mechanism and more particularly, to a paper transport control device for use in a mechanical arrangement including a manual paper feeding mechanism.

Generally, in an electrophotographic copying apparatus, for example, there has been employed a jam detecting mechanism which automatically operates when the copying has been started. Accordingly, even in manual paper feeding whereby copy paper sheets are manually supplied one sheet by one sheet, jam detection is performed as in the automatic paper feeding after the paper feeding has been started. However, in the manual paper feeding, there are cases where an operator has become aware of malfunction in the paper feeding after the paper has been inserted into the copying apparatus and then draws the paper out suddenly. Meanwhile, since, in the case of manual paper feeding, the detection of the leading edges of copy paper sheets in response to the paper insertion is arranged to be effected simultaneously with the operation of a print button during normal copying, the copying is started once the paper has been inserted into the paper feeding inlet as described above, and the copying sequence automatically proceeds even if the paper is drawn out thereafter. Accordingly, even when the paper is drawn out and thus not transported to a predetermined position, the situation is detected as a copy paper jamming, with the consequent suspension of the copying functioning. Therefore, the resumption of the copying has presented various problems such as requiring extremely complicated restarting operations, e.g., depressing a reset button after opening the cover of the copying apparatus.

SUMMARY OF THE INVENTION

Accordingly, an essential object of the present invention is to provide an improved paper transport control device for use in a mechanical arrangement including a manual paper feeding mechanism, in which at least one of the mechanical functions, such as jam detection, is caused to be inoperative when the paper is drawn out within a predetermined period of time after the paper has been fed manually, so as to enable the immediate resumption of the next mechanical operations even if the paper is drawn out after the manual paper feeding has been started.

Another important object of the present invention is to provide an improved paper transport control device as described above which is simple in construction and highly reliable in actual use, and can be readily incorporated into electrophotographic copying apparatuses or the like at a low cost.

In accomplishing these and other objects according to a preferred embodiment of the present invention, there is provided an improved paper transport control device for use in a mechanical arrangement including a manual paper feeding mechanism, in which mechanical operations, such as jam detection, are caused to be inoperative when the paper is drawn out within a predetermined period of time after the starting of the paper feeding. In accordance with the present invention, immediate resumption of the next mechanical operation is possible even if the paper is drawn out after the manual paper feeding has been started, thus significantly improving the working efficiency of the arrangement.

BRIEF DESCRIPTION OF THE DRAWINGS

These and other objects and features of the present invention will become apparent from the following description taken in conjunction with the preferred embodiment thereof with reference to the accompanying drawings, in which.

Before the description of the present invention proceeds, it is to be noted that like parts are designated by like reference numerals throughout the views of the accompanying drawings.

DETAILED DESCRIPTION OF THE INVENTION

Figure 1:
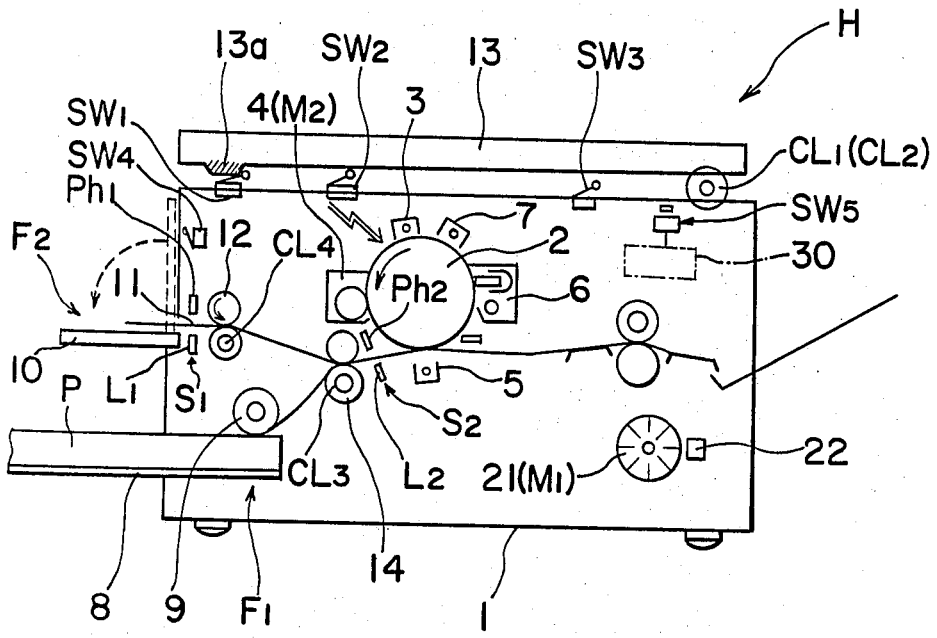
FIG. 1 is a schematic side sectional view of a copying apparatus to which a paper transport control device according to the present invention may be applied.

Referring now to the drawings, there is shown in FIG. 1 a copying apparatus H in which a paper transport control device according to the present invention is employed. The copying apparatus H includes a photoreceptor drum 2 which is rotatably mounted at approximately a central portion of an apparatus housing 1 for rotation in the counterclockwise direction, and around which a corona charger 3, a developing device 4, a transfer charger 5, a cleaning device 6, an eraser lamp 7, etc. are sequentially disposed along the circumference of the photoreceptor drum 2 in a known manner so as to successively process the surface of the drum 2 as the photoreceptor drum 2 rotates. A copy paper feeding mechanism of the copying apparatus H comprises an automatic paper feeding mechanism $F_1$ by which copy paper sheets stacked in a cassette 8 are fed into the copying apparatus H one sheet by one sheet through the rotation of a paper feeding roller 9 which is rotatably provided in contact with the leading edge of the uppermost sheet of the stack of the copy paper sheets P, and by a manual paper feeding mechanism $F_2$ which is so arranged that a manual paper feeding tray 10 is brought down from a position shown by dotted lines to a position shown by solid lines and is arranged so that the copy paper is manually inserted into a manual paper feeding inlet 11 one sheet by one sheet so as to be fed into the copying apparatus through rotation of a pair of manual paper feeding rollers 12 which are rotatably provided adjacent to the corresponding side edge of the tray 10. The presence or absence of the tray 10 at the dotted line position is detected by a detection switch SW4, and, when said manual paper feeding tray 10 is not detected by a detection switch SW4, control the mode of the copying apparatus H is changed over to the manual mode. An original platform 13 is reciprocatingly provided above and adjacent to the upper portion of the apparatus housing 1 for scanning from the left to the right when an original to be copied is placed on a transparent plate (not shown) provided on the original platform 13 and the image of the original is projected onto the surface of the photoreceptor drum 2 through an optical system (not shown). A switch actuating cam 13*a* is provided on the undersurface adjacent to one edge of the platform 13 and actuates a positioning switch SW1, a timing switch SW2 and a return switch SW3 which are sequentially disposed on the upper portion of the apparatus housing 1 along the path of movement of the platform 13 when the original platform 13 is moved. A pulse generating disc 21 rotates synchronously with a main motor (not shown) and a pulse signal generator 22 generates a series of pulse signals in response to the rotation of the pulse generating disc 21. In a copying operation employing the automatic paper feeding mechanism $F_1$ which will be described more in detail later, when a print switch SW5 is turned ON, the paper feeding roller 9 is driven so as to start the transport of the copy paper P and the scanning movement of the original platform 13 is started so as to turn ON the timing switch SW2, whereby timing rollers 14 are driven and a timer for detecting copy paper jamming (referred to as jam detection hereinbelow) to be described later is set. The jam detection is performed by the above-described timer for jam detection and a jam sensor S2.

Meanwhile, in the case of a copying operation employing the manual paper feeding mechanism $F_2$, when the leading edge of the copy paper sheet is detected by a sensor S1, the copying operation is started and the manual paper feeding rollers 12 are rotated through a slight time delay. Then, the scanning movement of the original platform 13 is started and thereafter, the same operations as in the aforementioned automatic paper feeding case are performed.

Signals from the sensors S1 and S2, switches SW1 to SW4, print switch SW5, pulse signal generator 22, etc. as described above, are processed by, e.g., a control device 30 which is provided with a microcomputer and the operation of the copying apparatus H is controlled by control signals from the control device 30. The above-described control device 30 will be described in detail hereinbelow.

Figure 2:
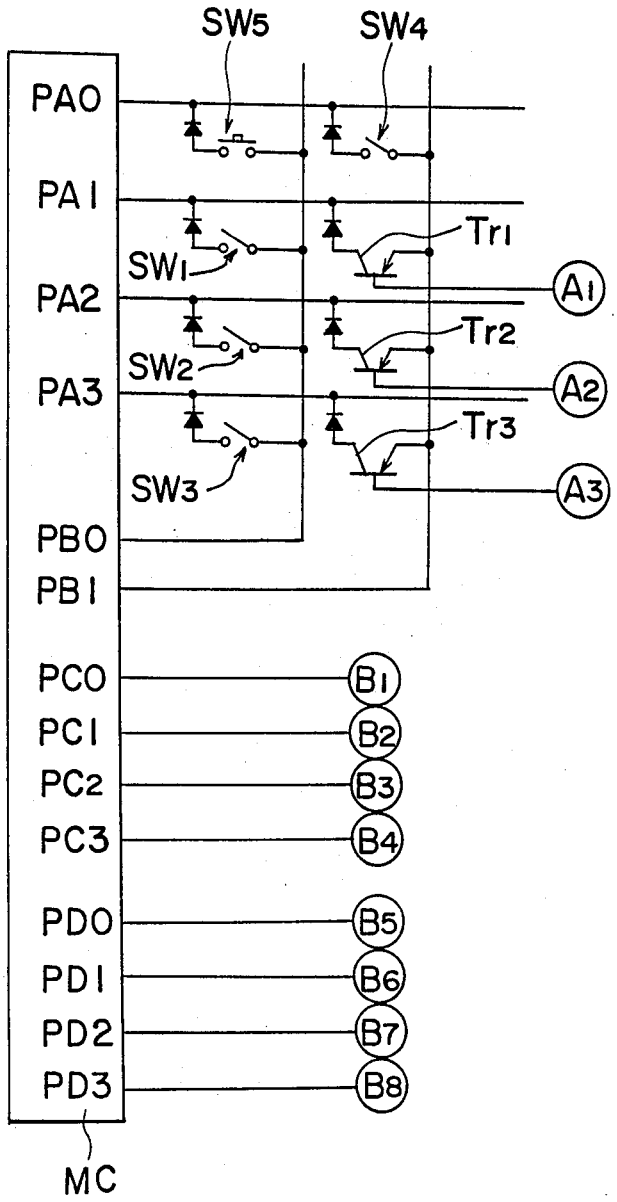
FIG. 2 is an electrical circuit diagram showing a microcomputer and switch members which are connected thereto and which are employed in the copying apparatus of FIG. 1.

Referring now to FIG. 2, there is shown a microcomputer MC including input ports PA0, PA1, PA2 and PA3, and output ports PB0, PB1, PC0, PC1, PC2, PC3, PD0, PD1, PD2 and PD3. The output port PB0 is connected to the input port PA0 through the print switch SW5, and is connected to the input port PA1 through the positioning switch SW1, and is connected to the input port PA2 through the timing switch SW2 and is connected to the input port PA3 through the return switch SW3. The output port PB1 is connected to the input port PA0 through the switch SW4 for detecting the manual paper feeding tray 10, and is connected to the input port PA1 through the emitter-collector circuit of a transistor Tr1 whose base is connected to an output A1 of a manual paper feeding sensor S1; the out port PB1 is connected to the input port PA2 through the emitter-collector circuit of a transistor Tr2 whose base is connected to an output A2 of a jam sensor S2, and the out port PB1 is connected to the input port PA3 through the emitter-collector circuit of a transistor Tr3 whose base is connected to an output A3 of the pulse generator 22. Outputs of the output ports PC0, PC1, PC2, PC3, PD0, PD1, PD2 and PD3 of the microcomputer MC are respectively B1, B2, B3, B4, B5, B6, B7 and B8, as shown in FIG. 2.

Figure 3:
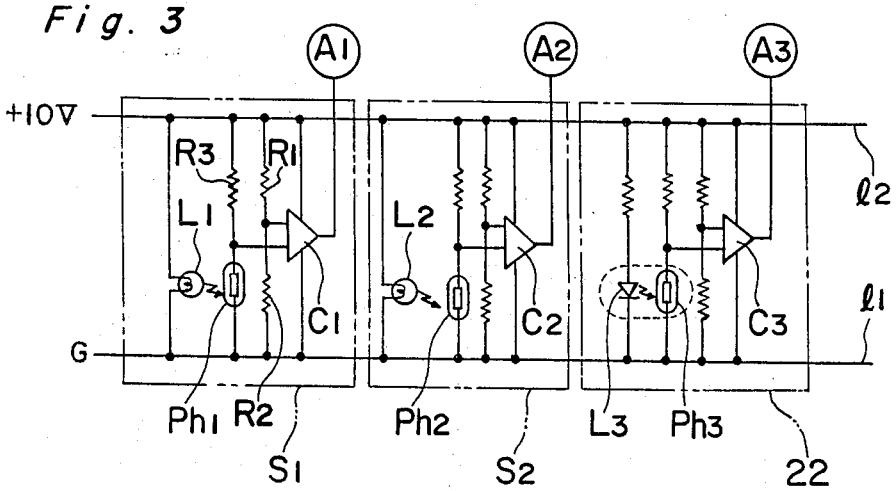
FIG. 3 is an electrical circuit diagram of the paper sensors employed in the arrangement of FIG. 1.

Electrical circuits of the above-described manual paper feeding sensor S1, jam sensor S2 and pulse generator 22 are shown in FIG. 3. The manual paper feeding sensor S1 includes a lamp L1, a photo detector Ph1 and a comparator C1, with the paper passage of the copying apparatus H being provided between the lamp L1 and the photo detector Ph1. The lamp L1 and comparator C1 are connected in parallel between a lead line l1 and a lead line l2. Suitable resistors R1 and R2 are connected in series between the lines l1 and l2 to provide a reference voltage to one input of the comparator C1. The other input of the comparator C1 is connected to a junction between a resistor R3 and the photo detector Ph1 which are connected in series between the lines l1 and l2. The output A1 of the comparator C1 is so arranged as to be set to the LOW state when the copy paper passes between the lamp L1 and the photo detector Ph1. The transistor Tr1 is turned ON when the output A1 of the comparator C1 is set to the LOW state.

Meanwhile, the jam sensor S2 has the same circuit arrangement as the manual paper feeding sensor S1 and includes a lamp L2, a photo detector Ph2 and a comparator C2 with the paper passage of the copying apparatus H being provided between the lamp L2 and the photo detector Ph2. The output A2 of the comparator C2 is so arranged as to be set to the LOW state when the copy paper passes between the lamp L2 and the photo detector Ph2. The transistor Tr2 is turned ON when the output A2 of the comparator C2 is set to the LOW state.

The pulse generator 22 has the same circuit arrangement as the manual paper feeding sensor S1 and jam sensor S2 and includes a light emitting diode L3, a photo detector Ph3 and a comparator C3. The disc 21 with slits formed at an equal interval along the circumference is disposed between the light emitting diode L3 and the photo detector Ph3. In response to the rotation of the disc 21, the pulse generator 22 generates the output A3 of a synchronous pulse train proportional to the drive speed of the motor M1.

Figure 5:
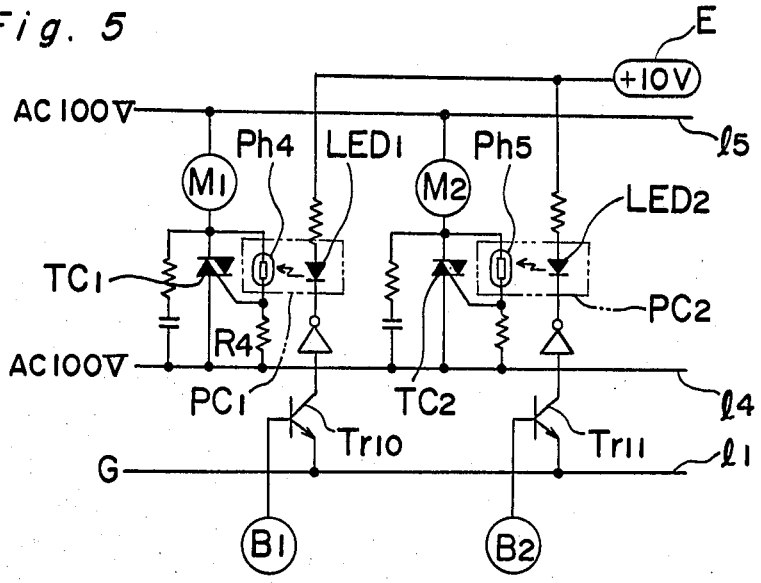
FIG. 5 is an electrical circuit diagram of a motor driving circuit controlled by the microcomputer of FIG. 2.

The outputs B1 and B2 of the respective output ports PC0 and PC1 of the microcomputer MC shown in FIG. 2 are connected to a circuit for respectively driving a main motor M1 and a developing motor M2, as shown in FIG. 5. The motor drive circuit is connected to lead lines l1, l4 and l5 and a source of voltage E, and includes a first circuit portion for driving the main motor M1 and a second circuit portion for driving the developing motor M2.

The first circuit portion for driving the main motor M1 further includes a transistor Tr10, a light emitting diode LED1, a photo detector Ph4, a TRIAC TC1 and the main motor M1. The output B1 of the output port PC0 of the microprocessor MC is connected, through the transistor Tr10, to the light emitting diode LED1 leading to the source of voltage E. The main motor M1 and TRIAC TC1 are connected in series between the lines l4 and l5. The photo detector Ph4 and a resistor R4 are connected in series across the TRIAC TC1. The light emitting diode LED1 and photo detector Ph4 form a photo coupler PC1. The emitter of the transistor Tr10 is connected to the line l1. When the output B1 of the output port PC0 is set to the HIGH state, the light emitting diode LED1 is turned ON and thus, the photo detector Ph4 conducts so that the TRIAC TC1 is triggered so as to turn ON the main motor M1.

The second circuit portion for driving the developing motor M2 has the same arrangement as the above-described circuit for driving the main motor M1 and includes a transistor Tr11, a light emitting diode LED2, a photo detector Ph5, a TRIAC TC2 and the developing motor M2. The light emitting diode LED2 and photo detector Ph5 form a photo coupler PC2. When the output B2 of the output port PC1 is set to the HIGH state, light emitting diode LED2 is turned ON and thus, the photo detector Ph5 conducts so that the TRIAC TC2 is triggered so as to turn ON the developing motor M2.

Figure 4:
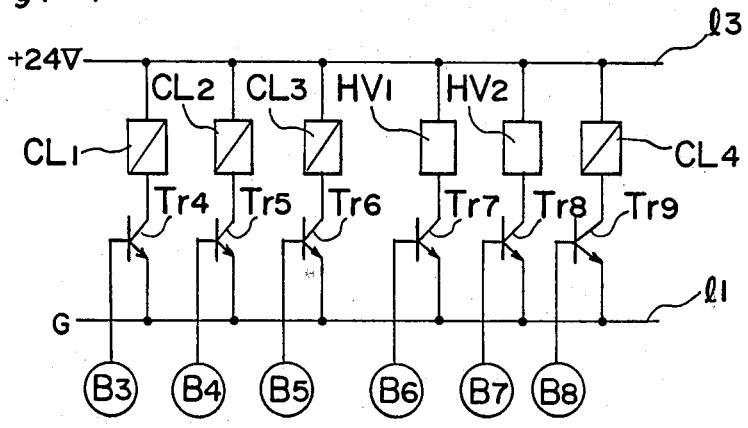
FIG. 4 is an electrical circuit diagram of a control circuit controlled by the microcomputer of FIG. 2.

The outputs B3 to B8 of the respective output ports PC2, PC3, PD0, PD1, PD2 and PD3 of the microcomputer MC shown in FIG. 2 are connected to a control circuit as shown in FIG. 4. The control circuit is connected to lead lines l1 and l3. Referring to a control circuit for the output B3, a scan clutch CL1 for scanning the movement of the original platform 13 and a transistor Tr4 are connected in series between the lines l1 and l3. The output B3 is connected to the base of the transistor Tr4. When the output B3 is set to the HIGH state, the transistor Tr4 is turned ON and thus, the scan clutch CL1 is turned ON. In the same manner as described above, the output B4 is connected, through a transistor Tr5, to a return clutch CL2 for returning the original platform 13; the output B5 is connected, through a transistor Tr6, to a clutch CL3 for driving the timing rollers 14; the output B6 is connected, through a transistor Tr7, to a high voltage power source HV1 for the corona charger 3; the output B7 is connected, through a transistor Tr8, to a high voltage power source HV2 for the transfer charger 5, and the output B8 is connected, through a transistor Tr9, to a manual paper feeding clutch CL4 for driving the manual paper feeding rollers 12. When the outputs B4 to B8 are set to the HIGH state, transistors Tr5 to TR9 are respectively turned ON, and thus, the return clutch CL2, clutch CL3 for driving the timing rollers 14, the high voltage power source HV1 for the corona charger 3, the high voltage power source HV2 for the transfer charger 5 and manual paper feeding clutch CL4 are respectively turned ON.

Meanwhile, in the same arrangement as described above, the paper feeding roller 9, eraser lamp 7, etc. are controlled.

As described above, the microcomputer MC is related to each mechanism of the copying apparatus 1 and operational control of each mechanism of the copying apparatus 1 is performed in accordance with programs stored in a memory of the microcomputer MC.

One example of the concrete processing sequence will be described in accordance with flow charts composed of blocks 100 to 900 in FIGS. 6(*a*) to 6(*d*), with reference to time charts in FIGS. 7 and 8, hereinbelow.

Process in block 100

Figure 6:
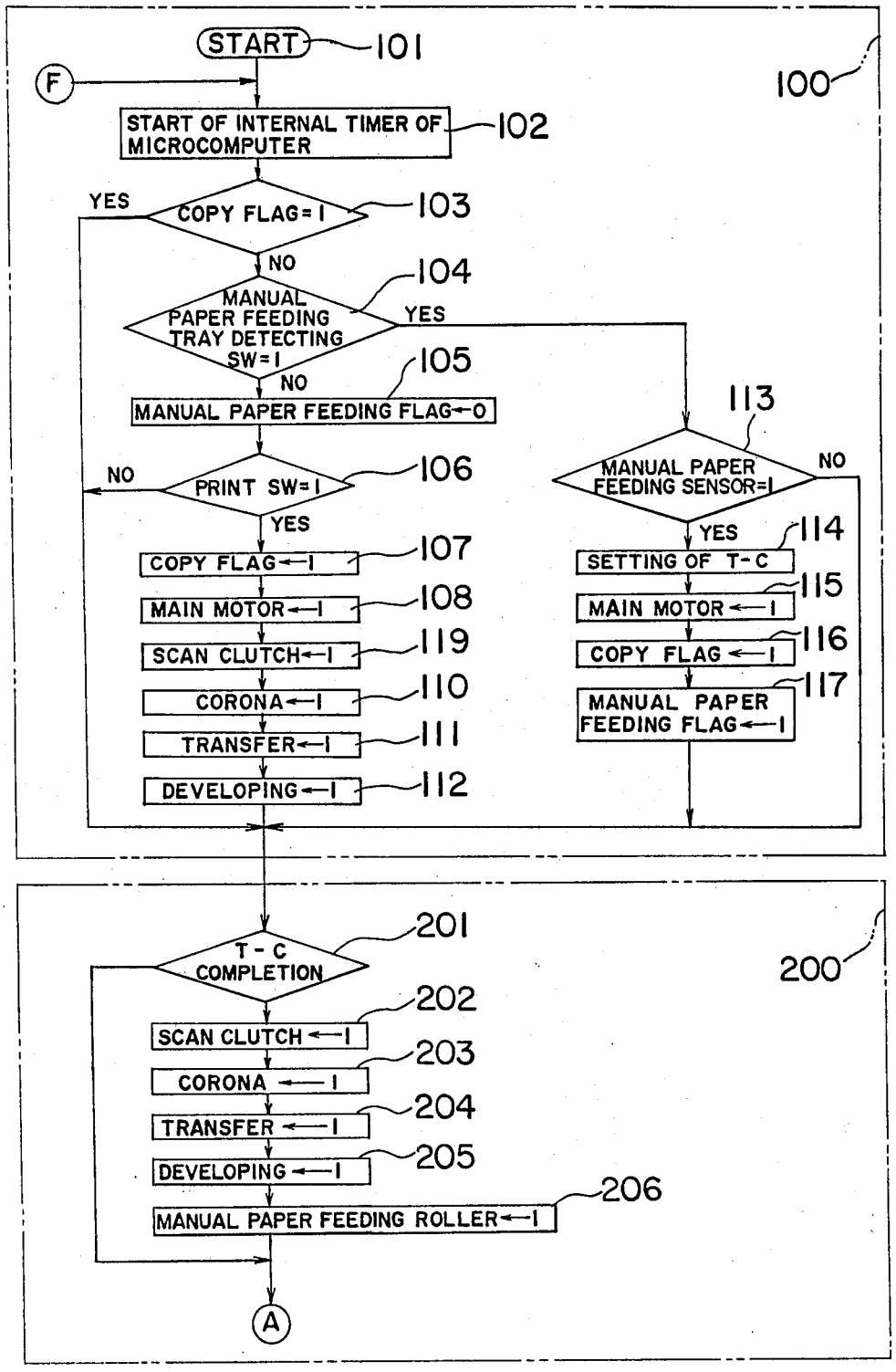
FIGS. 6(*a*) to 6(*d*) are flow charts showing the processing sequences of the operational control of the copying apparatus by the microcomputer.
Figure 6B:
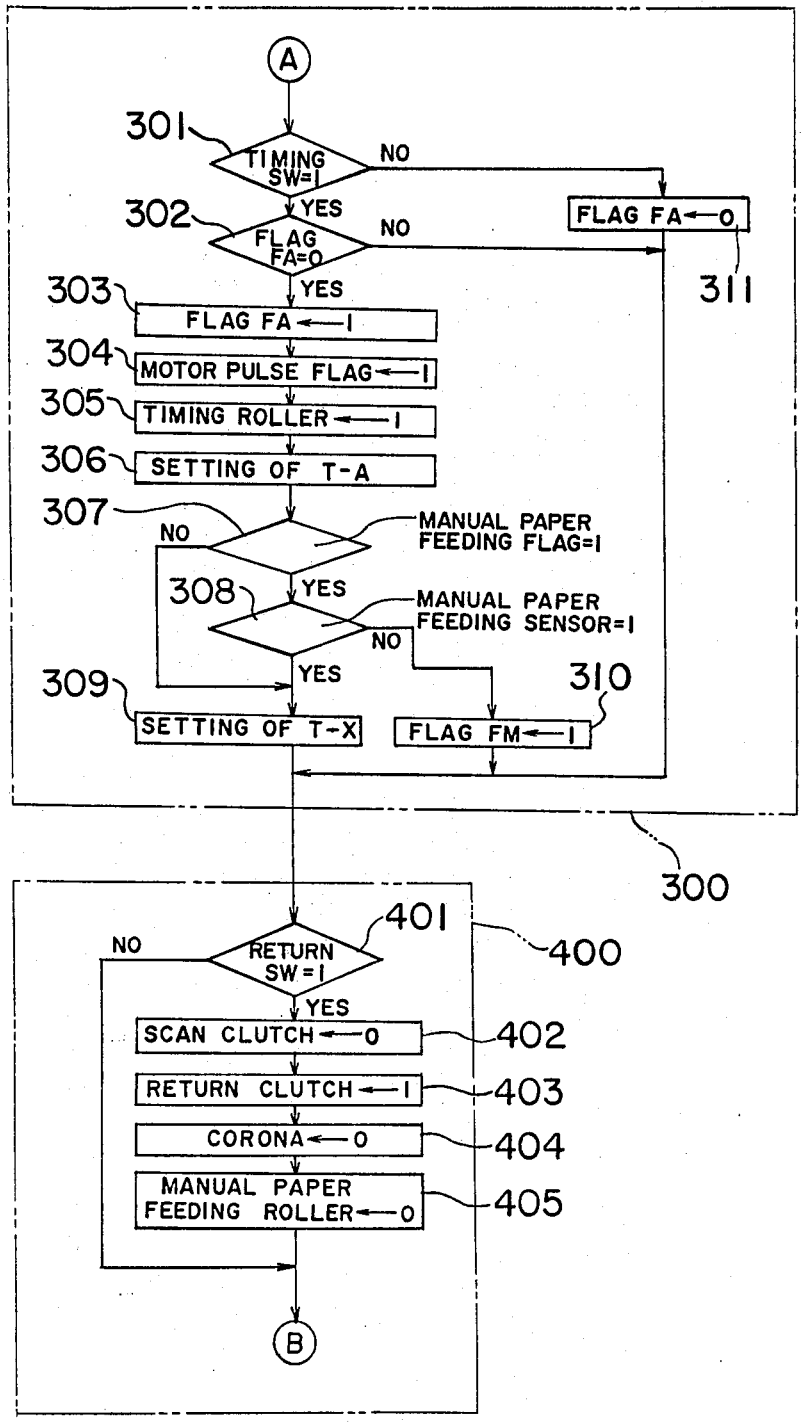
Figure 6C:
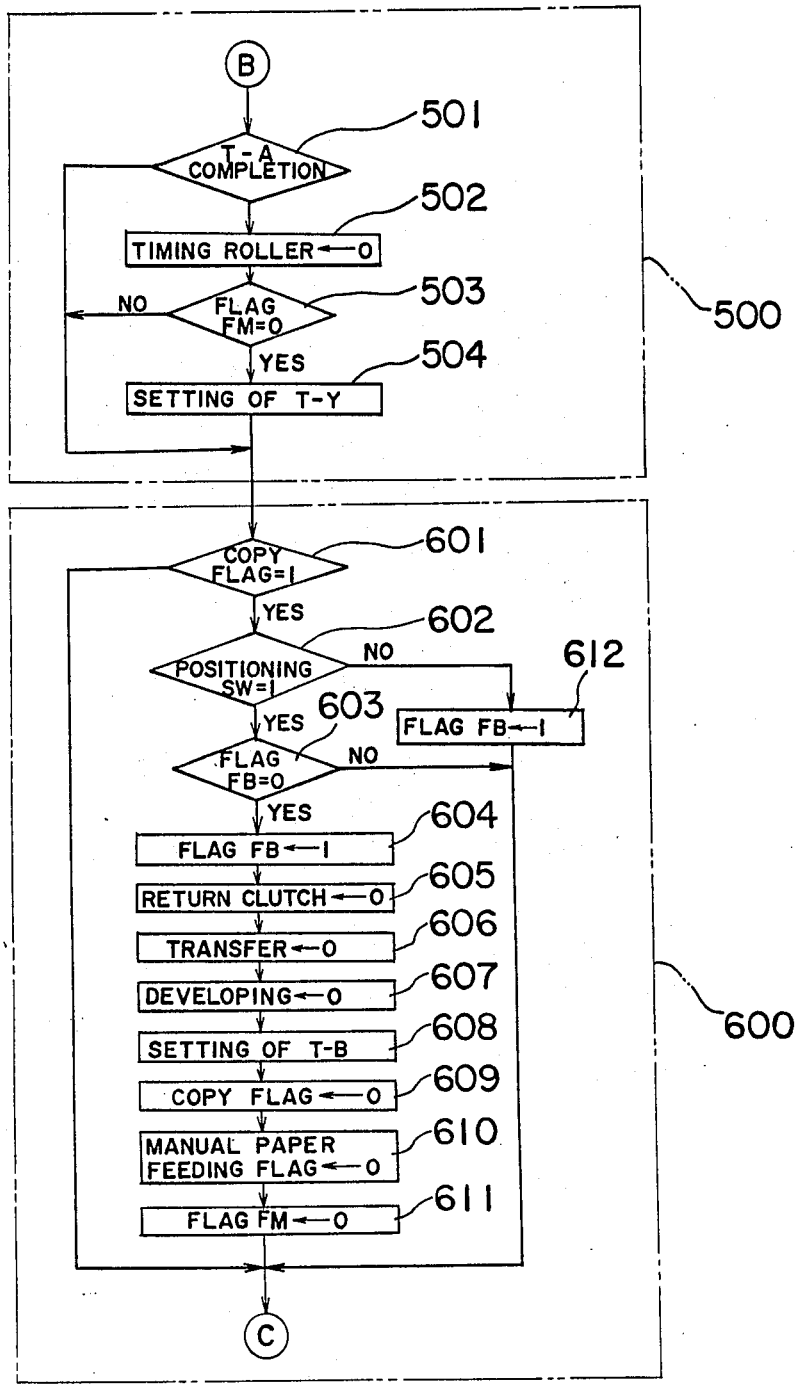
Figure 6:
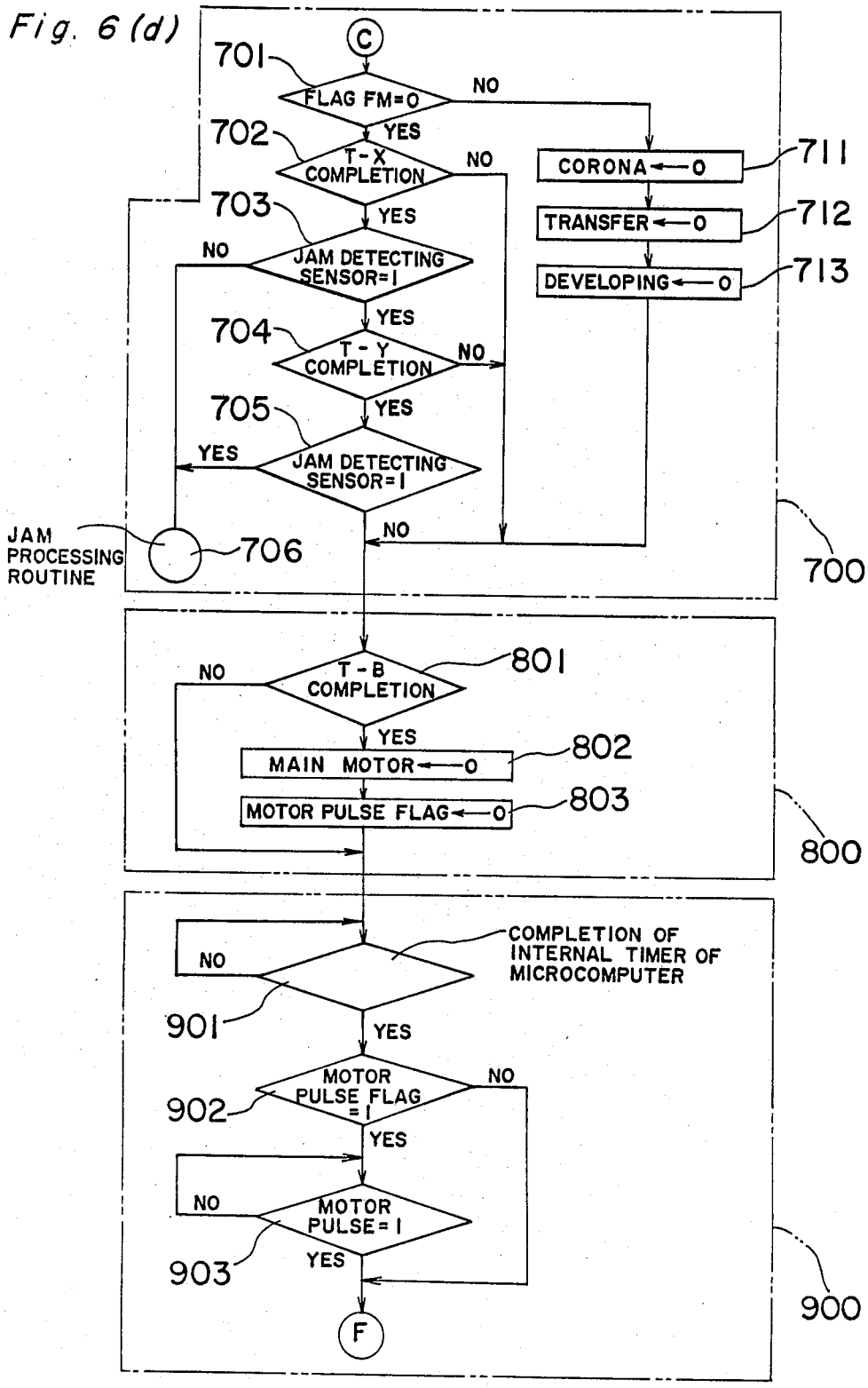
Figure 7:
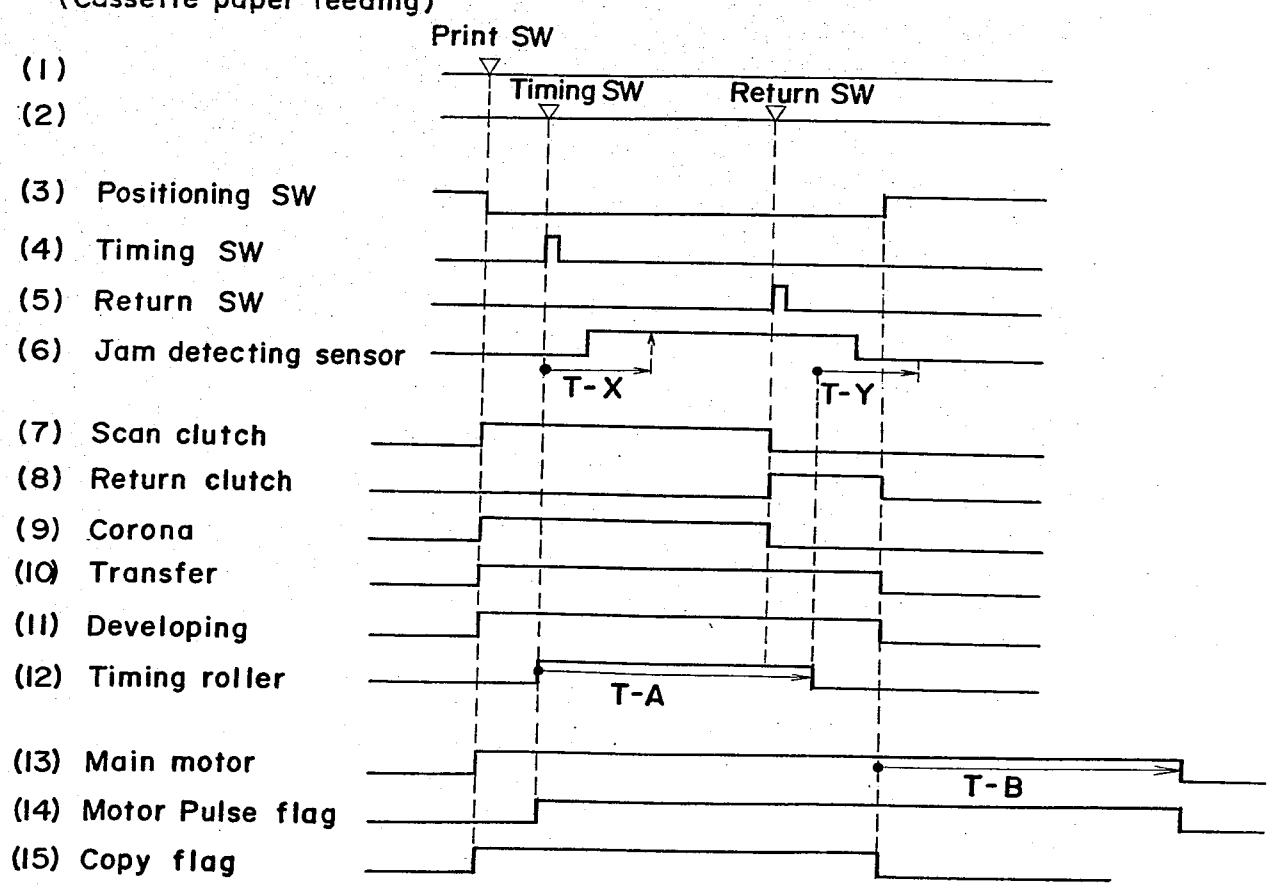
FIG. 7 is a time chart explanatory of operation of each part of the copying apparatus in the case of cassette paper feeding.

In block 100 in FIG. 6(*a*), the microcomputer MC starts an internal timer at a step 102 following a step 101 for starting the program processing. The internal timer above will be described later but more detailed description thereof is disclosed in Japanese Laid Open patent application, No. Tokkaisho 54-141134. (U.S. Pat. No. 4,280,763, issued July 28, 1981.

At a step 103, a decision is made as to whether or not a copy flag Fc is "1". When the copy flag Fc is respectively a "1" and a "0", the copying apparatus H is in operation and not in operation, i.e., the start of the next copying operation is possible.

At step 104, a decision is made as to the state of the detection switch SW4 for detecting the manual paper feeding tray 10. If the tray 10 is not brought down for manual paper feeding, a step 105 follows so as to set a manual paper feeding flag Fm to "0". If depressing of the print switch SW5 is detected at a step 106, as shown in FIG. 7(1), a copying mode for manual paper feeding is started so as to set the copy flag Fc to "1" at a step 107. (See FIG. 7(15).) Then, at steps 108 to 112, the main motor M1, scan clutch CL1, corona charger 3, transfer charger 5, paper feeding roller 9 and developing motor M2 are respectively turned on in this order. (See FIG. 7, (13), (7), (9), (10) and (11).)

On the contrary, if the manual paper feeding tray 10 is brought down for manual paper feeding, a step 113 follows so as to await a signal from the manual paper feeding sensor S1. If the leading edge of copy paper is detected by the sensor S1, a timer T-C for providing a time allowance of approximate 500 msec. between turning on of the sensor S1 and that of the paper feeding rollers 12 is set at a step 114 (see FIG. 8, (1) and (3)) and the main motor M1 is turned on at a step 115 (see FIG. 8, (15)). Then, at steps 116 and 117, the copy flag Fc and manual flag Fm are respectively set to "1".

Process in block 200

Figure 8:
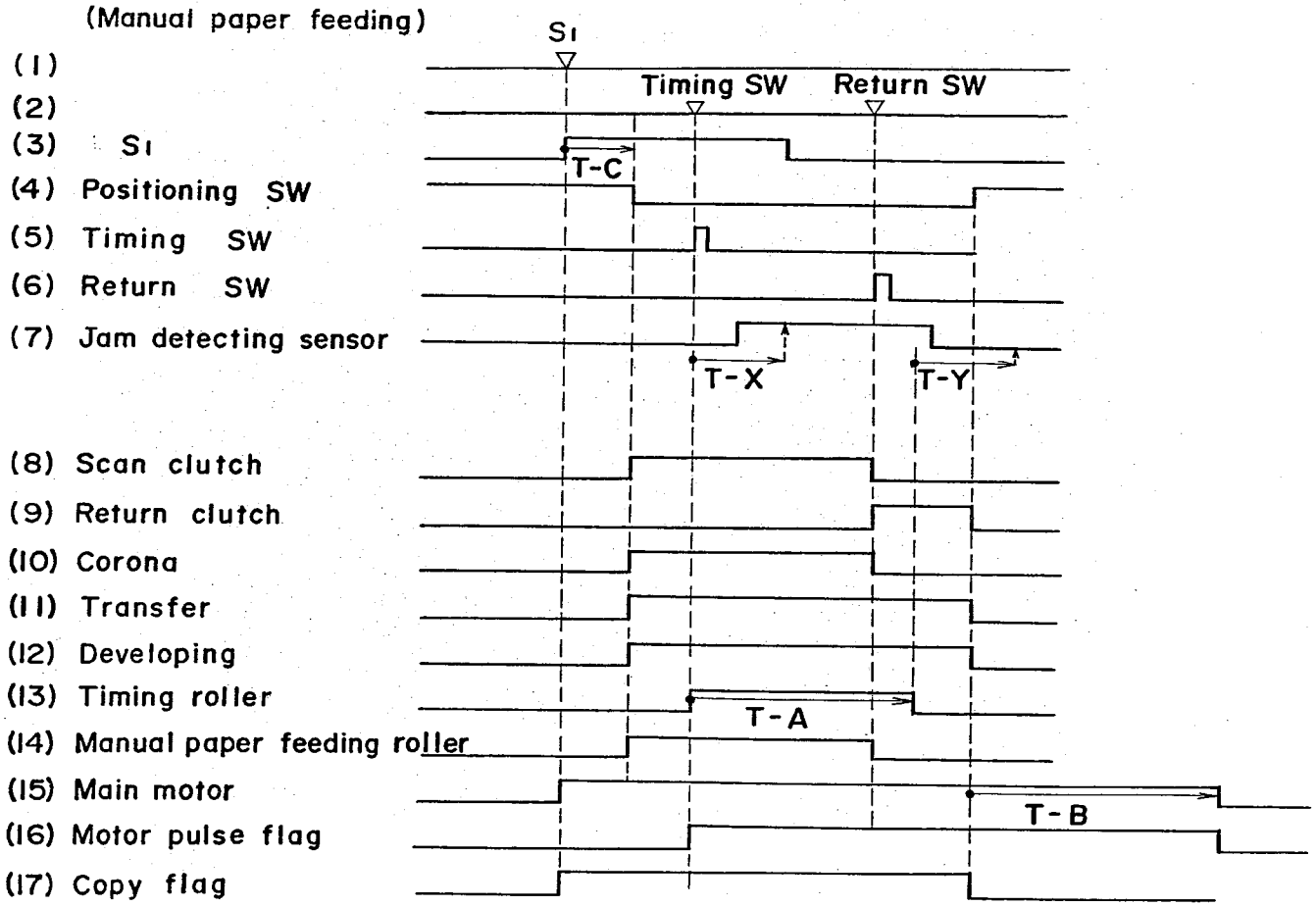
FIG. 8 is a time chart explanatory of operation of each part of the copying apparatus in the case of manual paper feeding.

In block 200, when the timer T-C stops at a step 201 (see FIG. 8, (3)), the scan clutch CL1, corona charger 3, transfer charger 5, developing motor M2 and manual paper feeding rollers 12 are respectively turned on at steps 202 to 206, (see FIG. 8, (8), (10), (11), (12) and (14)) and proceeds to block 300.

Process in block 300

In block 300 in FIG. 6(*b*), processing is performed in the case of paper feeding having been started in accordance with decisions and processing in blocks 100 and 200 and the timing switch SW2 being turned on by the cam portion 13*a* provided on the original platform 13 in response to start of scanning movement of the original platform 13.

At a step 301, a decision is made as to the state of the timing switch SW2; in the case of a "YES" determination, a decision is made as to whether or not a flag FA to be described at a step 303 is a "0" at a step 302 and in the case of a "NO" determination, the flag FA is set to a "0" at a step 311. As shown in a step 303, the flag FA is set to a "1" in a routine by which a decision is made that the timing switch SW2 is in the ON state. At a step 302, a decision is made for confirming rise of the timing switch SW2. When a decision is made that the timing switch SW2 is turned on and that rise of the output thereof takes place as shown in FIG. 7, (2) and (4), and FIG. 8, (2) and (5), the flag FA is set to a "1" at a step 303 and a motor pulse flag FP to be described later is set to a "1" at a step 304 (see FIG. 7, (14) and FIG. 8, (16)). Then, at a step 305, the clutch CL3 for the timing rollers 14 is turned on (see FIG. 7, (12) and FIG. 8, (13)) and at a step 306, a timer T-A for turning off the timing rollers 14 is set (see FIG. 7, (12) and FIG. 8, (13)). Then, at a step 307, a decision is made as to the state of the manual paper feeding flag Fm. If the manual flag Fm is a "1", i.e., copying is in the manual paper feeding mode, a decision is made again as to the state of the manual paper feeding sensor S1 at a step 308. If the copy paper is not detected, a flag FM is set to a "1" at a step 310. When the manual paper feeding flag Fm is a "0" at the step 307 and the manual paper feeding sensor S1 is a "1" at the step 308, a timer T-X for jam detection of the leading edge of the copy paper is set at a step 309 (see FIG. 7, (6) and FIG. 8, (7)). The timer T-X is so set as to stop when the leading edge of the copy paper has just passed through the jam sensor S2 in both cassette paper feeding and manual paper feeding (see FIG. 7, (6) and FIG. 8, (7)).

Process in block 400

In block 400, processing is performed in the case of the return switch SW3 having been depressed by the cam portion 13*a* provided on the original platform 13. When a decision is made that the return switch SW3 has been depressed at a step 401, the scan clutch CL1 is turned off, the return clutch CL2 is turned on, and the corona charger 3 and clutch CL4 for the manual paper feeding rollers 12 are respectively turned off at steps 402 to 405, (see FIG. 7, (5), (7), (8) and (9) and FIG. 8, (6), (8), (9) and (10)).

Process in block 500

In block 500 in FIG. 6(*c*), processing is performed in the case of the timer T-A having stopped. When a decision is made that the timer T-A has stopped, at a step 501, the clutch CL3 for the timing rollers 14 is turned off at a step 502 (see FIG. 7, (12) and FIG. 8, (13)) and at a step 503, a decision is made as to the state of the flag FM, which is set to a "1" when withdrawal of the copy paper after manual paper feeding has been detected. When the copy paper is transported and the flag FM is a "0", than a timer T-Y for detecting a jam of the trailing edge of the copy paper is set at step 504 (see FIG. 8, (7)). The timer T-Y is set so as to stop after the trailing edge of the transported copy paper has passed through the jam sensor S2 (see FIG. 7, (12) and (6) and FIG. 8, (13) and (7)).

Process in block 600

In block 600, processing is performed in the case of the original platform 13 having been returned and the positioning switch SW1 having been depressed by the cam portion 13*a*. At a step 601, a decision is made as to whether or not the copying apparatus H is in operation. When the copy flag Fc is a "1", a decision is made as to the state of the positioning switch SW1 at a step 602. When the positioning switch SW1 has been depressed by the cam portion 13*a*, a decision is made as to rise thereof by a flag FB at a step 603. If the flag FB is a "0", the flag FB is set to a "1" at a step 604. Then, at steps 605 to 608, the return clutch CL2, transfer charger 5 and developing motor M2 are turned off and a timer T-B for automatic shut is set (see FIG. 7, (3), (8), (10), (11) and (13), and FIG. 8, (4), (9), (11), (12) and (15), respectively). At steps 609 to 611, the copy flag Fc, the manual paper feeding flag Fm and the flag FM are respectively set to a "0" (see FIG. 7, (15) and FIG. 8, (17)). If the positioning switch SW1 has not been depressed by the cam portion 13*a*, the flag FB is set to a "1" at a step 612.

Process in block 700

In block 700, processing for jam detection is performed. At a step 701, a decision is made as to the state of the flag FM which indicates the withdrawal of the copy paper after the manual paper feeding has been started. When the flag FM is a "1", there is no need for producing an image and thus, the corona charger 3, the transfer charger 5 and the developing motor M2 are turned respectively off at steps 711, 712 and 713, and the jam detecting timers T-X and T-Y are not set, so that jam detection is not performed.

Meanwhile, when the flag FM is a "0", decisions are made at steps 702 to 705. Namely, if a decision is made that the copy paper is not detected by the sensor S2 at a step 703 (S2="0") when the timer T-X has stopped at a step 702 and if the copy paper is detected by the sensor S2 at a step 705 (S2="1") when a decision is made that the timer T-Y has stopped at a step 704, a decision is made that a jam has taken place and a jam processing routine 706 for stopping the main motor M1, etc. are executed.

Process in block 800

In block 800, processing is performed in the case of the auto-shut timer T-B having been stopped. When a decision is made that the timer T-B has stopped at a step 801, the main motor M1 is turned off at a step 802 and a motor pulse flag FP is set to a "0" at a step 803 (see FIG. 7, (13) and (14), and FIG. 8, (15) and (16), respectively).

Process in block 900

In block 900, processing is performed for synchronizing the program processing time of the microcomputer MC with the drive speed of the copying apparatus H. At a step 901, a decision is made as to whether the internal timer of the microcomputer MC has stopped, i.e., completion of the program processing of one routine. At a step 902, a decision is made as to whether or not the motor pulse flag FP is a "1". As described earlier, the motor pulse flag FP is set to a "1" when the timing switch SW2 has been turned on and thereafter, the paper transport and the control signals of the microcomputer MC are synchronized with pulse signals from the motor pulse generator 22. At a step 903, the next program processing is not started until a motor pulse is detected after the internal timer of the microcomputer MC has stopped.

Figure 9:
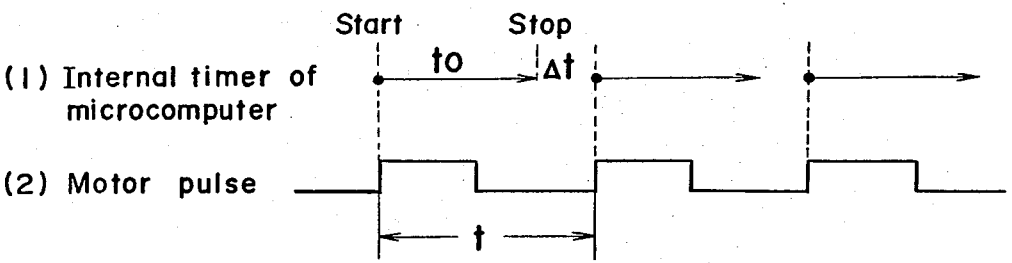
FIG. 9 is a time chart explanatory of the relationship between a motor pulse and an internal timer of the microcomputer.

Referring now to processing in block 900 in more detail, the internal timer of the microcomputer MC is related to a pulse signal generated by the pulse generator 22 as respectively shown in FIG. 9, (1) and (2). Namely, the processing time from the step 102 to the step 901 in the flow charts as shown in FIGS. 6(*a*) to 6(*d*), is set by the internal timer of the microcomputer MC so that the next processing routine may be started in response to the input of a pulse signal after a decision has been made that the internal timer has stopped. Accordingly, even if variations in the drive speed of the main motor M1 causes variations in a period t of a pulse from the pulse generator 22, the variations can be absorbed by a latency time $\Delta t$ if a set period of time $t_0$ of the internal timer of the microcomputer MC and the period t are set as follows: $t_0 < t$, thus eliminating a gap between the control signal from the microcomputer MC and the transport of the copy paper.

Meanwhile, timers T-A, T-B, T-C, T-X and T-Y are digital timers which are so programmed that they are counted up by one count for every additional program processing routine of the microcomputer MC as described above and their set periods of time are stored in a memory (not shown) as numerical data. The arrangement of above-described timers T-A, T-B, T-C, T-X and T-Y is also fully disclosed in Japanese Laid Open patent application, No. Tokkaisho 54-141134 (U.S. Pat. No. 4,208,763). Also, the internal timer of the microcomputer MC is disclosed in the above-described Japanese Laid Open patent application, No. Tokkaisho 54-141134 and the internal timer acts as a timer by counting standard clock pulses stored in the microcomputer MC.

Meanwhile, a timing for turning off the above-described timing rollers 14 and a timing at which the trailing edge of the copy paper has passed through the jam sensor S2 are required to be set in accordance with the length of the copy paper and thus, a timer setting mechanism as disclosed in, for example, Japanese Laid Open patent application, No. Tokkaisho 54-134645 (U.S. Ser. No. 28,322, filed Apr. 9, 1979), can be applied to the timer T-A so that the set period of time thereof can be varied in accordance with the length of the copy paper.

In the above-described example of the embodiment, a decision as to whether or not the copy paper is drawn out after the copy paper has been detected by the sensor S1 is made when the timing switch SW2 is turned on in response to movement of the original platform 13 and this decision can be made by setting a timing at which the manually fed paper is still detected by the sensor S1 when manual paper feeding has been properly performed and at the timing a decision is made as to the presence of the paper, whereby if the manually fed paper is not present, the flag FM is set to a "1" by supposing that the paper has been drawn out and the corona charger and transfer charger are turned off. Adequate timing mechanisms such as a cam or a timer can be employed for a means of the above-described decision.

Meanwhile, for processing in the case of the flag FM being a "1", such methods as turning off an exposure lamp or returning the original platform by stopping scanning movement thereof as required can be adopted in addition to the above-described method.

Moreover, the present invention can be applied not only to a copying apparatus in which a stationary original is scanned optically, in addition to a copying apparatus in which the original platform 13 moves for scanning as described above, but also to a wide range of mechanical arrangements for performing various operations such as transporting, printing, counting or cutting paper, etc.

As is clear from the foregoing detailed description, the present invention relates to a paper transport control device for use in a mechanical arrangement including a manual paper feeding mechanism: said mechanical arrangement comprising; a paper transport device for transporting paper, a manual paper feeding mechanism for manually feeding the paper into said paper transport device, and a manual paper feed detecting device for detecting the manually fed paper in the vicinity of a manual paper feeding inlet, said paper transport control device comprising; an operational start commanding device for starting operations of said mechanical arrangement including at least said paper transport device in response to detection of the leading edge of the paper by said manual paper feed detecting device, a paper presence deciding device for deciding on the presence of the paper through a timing at which the paper transported in response to operations of said mechanical arrangement has not passed through said manual paper feed detecting device, and a control device for causing at least one of operations performed during transport of the paper in said mechanical arrangement to be inoperative if a decision has been made that the paper is absent by said paper presence deciding device.

Accordingly, in accordance with the present invention, even if the paper is drawn out after it has been manually fed into the mechanical arrangement, unnecessary operations of the mechanical arrangement can be avoided, thus offering many advantages for practical use. Meanwhile, when the present invention is applied to a copying apparatus provided with a jam detecting mechanism and jam detection is caused to be inoperative if withdrawal of the paper has been detected, the withdrawal of the paper does not lead to a decision of jam and thus, immediate resumption of the next copying is possible, thereby improving the working efficiency remarkably.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as included therein.

What is claimed is:

1. A paper transport control device comprising:

a paper transport device for transporting paper;

a manual paper feeding mechanism for manually feeding paper into said paper transport device;

a manual paper feed detecting device for detecting the manually fed paper in the vicinity of a manual paper feeding inlet;

an operational start commanding means for starting operations of said manual paper feeding mechanism and said paper transport device in response to detection of a leading edge of said paper by said manual paper feed detecting device;

a paper presence judging means for judging the presence or absence of said paper at a predetermined time at which said paper has been transported in response to operations of said manual paper feeding mechanism but has not yet passed through said manual paper feed detecting device; and a control means for causing at least one of said operations performed during transport of said paper in said paper transport device to be inoperative if a judgement has been made by said paper presence judging means that said paper is absent.

2. A paper transport control device as claimed in claim 1, wherein said paper transport device further comprises an automatic paper feeding mechanism and a changeover means for causing said automatic paper feeding mechanism and said manual paper feeding mechanism to be used selectively.

3. A paper transport control device as claimed in claims 1 or 2, wherein said paper transport device is in a transfer type copying apparatus which comprises a photoreceptor, a means for forming an image on the surface of said photoreceptor and a means for transferring said image to said paper.

4. A paper transport control device as claimed in claim 3, wherein said control means causes a jam detection operation to be inoperative by not setting a timer means for fixing a predetermined period of time for jam detection if a judgement has been made by said paper presence judging means that said paper is absent.

5. A paper transport control device for use in a copying apparatus comprising:

a photoreceptor;

a means for forming an image on the surface of said photoreceptor by applying a treatment including at least, corona charging, exposure, and development to said photoreceptor;

a transfer means for transferring said image to a copy paper;

a paper transport device for transporting said copy paper;

a manual paper feeding mechanism for manually feeding said copy paper into said paper transport device;

a manual paper feed detecting device for detecting said manually fed copy paper in the vicinity of a manual paper feeding inlet;

an operational start commanding means for starting operations of said copying apparatus including at least said paper transport device in response to detection of a leading edge of said copy paper by said manual paper feed detecting device;

a paper-presence judging means for judging the presence or absence of copy paper at a predetermined time at which said copy paper has been transported in response to operations of said copying apparatus but has not yet passed through said manual paper feed detecting device, and a control means for causing at least one of said operations performed during transport of said copy paper in said copying apparatus to be inoperative if a judgement has been made by said paper presence judging means that said copy paper is absent.

6. A paper transport control device as claimed in claim 5, wherein said copying apparatus comprises a jam detecting mechanism for transmitting a jam detection signal when said copy paper is not transported to a predetermined position within a predetermined period of time after the copy paper has been fed, and wherein said control means causes said jam detecting mechanism to be inoperative if the judgement has been made by said paper presence judging means that said copy paper is absent.

7. A paper transport control device as claimed in claim 6, wherein said control means causes said jam detecting mechanism to be inoperative by not setting a timer means for fixing a predetermined period of time for jam detection if a judgement has been made by said paper presence judging means that said copy paper is absent.

8. A paper transport control device as claimed in claim 5 or 6, wherein said control means causes means for said corona charging, said transfer and said development to be inoperative if a judgement has been made by said paper presence judging means that said copy paper is absent.

* * * * *